US008297906B2

(12) United States Patent
Nabata et al.

(10) Patent No.: US 8,297,906 B2
(45) Date of Patent: Oct. 30, 2012

(54) WORK EQUIPMENT BOOM

(75) Inventors: Eiji Nabata, Hirakata (JP); Tatsushi Itou, Hirakata (JP)

(73) Assignee: Komatsu Ltd., Tokyo (JP)

( * ) Notice: Subject to any disclaimer, the term of this patent is extended or adjusted under 35 U.S.C. 154(b) by 608 days.

(21) Appl. No.: 12/532,921

(22) PCT Filed: Apr. 22, 2008

(86) PCT No.: PCT/JP2008/057740

§ 371 (c)(1),
(2), (4) Date: Sep. 24, 2009

(87) PCT Pub. No.: WO2008/133244

PCT Pub. Date: Nov. 6, 2008

(65) Prior Publication Data

US 2010/0119344 A1 May 13, 2010

(30) Foreign Application Priority Data

Apr. 25, 2007 (JP) ..... 2007-115706

(51) Int. Cl.
*E02F 3/36* (2006.01)

(52) U.S. Cl. ..... 414/722; 414/685

(58) Field of Classification Search ..... 414/722; 29/891, 897.2; 52/111, 115–118
See application file for complete search history.

(56) References Cited

U.S. PATENT DOCUMENTS

| | | | | |
|---|---|---|---|---|
| 5,599,158 | A * | 2/1997 | Ajilore | 414/685 |
| 7,648,149 | B2 * | 1/2010 | Ryberg et al. | 280/124.106 |
| 2003/0118432 | A1 | 6/2003 | Lee | |

FOREIGN PATENT DOCUMENTS

| | | | |
|---|---|---|---|
| EP | 1 387 012 | A2 | 7/2003 |
| JP | 62-125165 | U | 8/1987 |
| JP | 06-313325 | A | 11/1994 |
| JP | 2001-81810 | A | 3/2001 |
| JP | 2002-507260 | A | 3/2002 |
| JP | 2003-193512 | A | 7/2003 |

OTHER PUBLICATIONS

Supplementary European Search Report of corresponding EP Application No. 08 75 1925.2 dated Mar. 25, 2011.

* cited by examiner

*Primary Examiner* — Donald Underwood
(74) *Attorney, Agent, or Firm* — Global IP Counselors

(57) ABSTRACT

A work equipment boom is adapted to be attached at one end to a main body of a construction machine and attached at the other end to a work equipment arm. the work equipment boom includes a boom main component. The boom main component is integrally formed by expanding a tubular material. The boom main component has a proximal end portion and a distal end portion. The proximal end portion includes a first end part arranged to be disposed adjacent to the main body and has a shape which increases in horizontal width as it gets nearer to the first end part. The distal end portion includes a second end part arranged to be disposed adjacent to the work equipment arm and has a shape which increases in horizontal width as it gets nearer to the second end part.

3 Claims, 12 Drawing Sheets

WORK EQUIPMENT BOOM

CROSS-REFERENCE TO RELATED APPLICATIONS

This national phase application claims priority to Japanese Patent Application No. 2007-115706, filed on Apr. 25, 2007. The entire disclosure of Japanese Patent Application No. 2007-115706 is hereby incorporated herein by reference.

TECHNICAL FIELD

The present invention relates to a work equipment boom.

BACKGROUND ART

Construction machines such as hydraulic shovels comprise a main body and a work equipment attached to the main body. The main body has a lower traveling body and an upper revolving body rotatably mounted on the lower traveling body via a revolving mechanism. The work equipment has a boom, an arm, a bucket, and other components, and the work equipment is attached to the upper revolving body. In such construction machines, the boom, the arm, and the bucket are driven by drive devices such as hydraulic cylinders, whereby various work can be performed.

In conventional practice, the boom, which is part of a work equipment such as the one described above, is formed by welding together a plurality of plate members (see Japanese Laid-Open Patent Application No. 2003-193512).

SUMMARY OF THE INVENTION

However, in a boom formed from a plurality of plate members such as the one described above, there is a fear of strength decreasing because of the numerous welded portions. There are also numerous steps for welding, and manufacturing is difficult.

An object of the present invention is to provide an easily manufactured work equipment boom having high strength.

The work equipment boom according to a first aspect of the present invention is a work equipment boom adapted to be attached to a main body of a construction machine at one end and to a work equipment arm at the other end. The work equipment boom includes a boom main component. The boom main component is integrally formed by expanding a tubular material. The boom main component has a proximal end portion and a distal end portion. The proximal end portion includes a first end part arranged to be disposed adjacent to the main body and has a shape which increases in horizontal width as it gets nearer to the first end part. The distal end portion includes a second end part arranged to be disposed adjacent to the work equipment arm and has a shape which increases in horizontal width as it gets nearer to the second end part.

In this work equipment boom, the boom main component is integrally formed by expanding a tubular material. Therefore, the number of welded portions can be reduced. Manufacturing can thereby be made easier with this work equipment boom, and strength can be improved. The boom main component also has a shape which increases in horizontal width nearer to the first end part and the second end part. The strength of the boom main component can thereby be improved. As used herein, the term "horizontal width" refers to a transverse width of the boom main component taken in a horizontal direction when the work equipment boom is oriented as being mounted to the construction machine.

The work equipment boom according to a second aspect of the present invention is the work equipment boom according to the first aspect, wherein the boom main component has a shape in which the horizontal widths of the first end part, the second end part, and a center part positioned between the first end part and the second end part are greater than the horizontal widths of a portion between the first end part and the center part and a portion between the second end part and the center part.

In this work equipment boom, the boom main component has a shape in which the horizontal widths of the first end part, the second end part, and the center part are greater than those of the portion between the first end part and center part and the portion between the second end part and center part. The strength of the boom main component can thereby be improved.

The work equipment boom according to a third aspect of the present invention is the work equipment boom according to the first aspect, wherein the boom main component has a curved shape. A concave part is formed in a side surface of a curved portion of the boom main component.

In this work equipment boom, a concave part is formed in the side surface of the curved portion of the boom main component. The strength of the boom main component can thereby be further improved in this work equipment boom.

The work equipment boom according to a fourth aspect of the present invention is the work equipment boom according to the third aspect, wherein a convex part is formed in the side surface of the curved portion of the boom main component so as to traverse the concave part.

In this work equipment boom, a convex part is also formed in the concave part formed in the side surface of the curved portion of the boom main component. Therefore, the strength of the boom main component can be further improved, more so than in cases in which only a concave part is formed.

The work equipment boom according to a fifth aspect of the present invention is the work equipment boom according to the fourth aspect, wherein a peak of the convex part is positioned further inward than a side surface of the boom main component and further outward than a bottom surface of the concave part.

In this work equipment boom, the peak of the convex part protruding from the bottom surface of the concave part is positioned farther inward than the side surface of the boom main component. The strength of the boom main component can thereby be further improved.

The work equipment boom according to a sixth aspect of the present invention is the work equipment boom according to any of the first through third aspects, wherein the boom main component has a curved shape, and a convex part is formed in a side surface of a curved portion of the boom main component.

In this work equipment boom, a convex part is formed in the side surface of the curved portion of the boom main component. The strength of the boom main component can thereby be further improved in this work equipment boom.

DETAILED DESCRIPTION OF THE PREFERRED EMBODIMENTS

Overall Configuration

Figure 1:
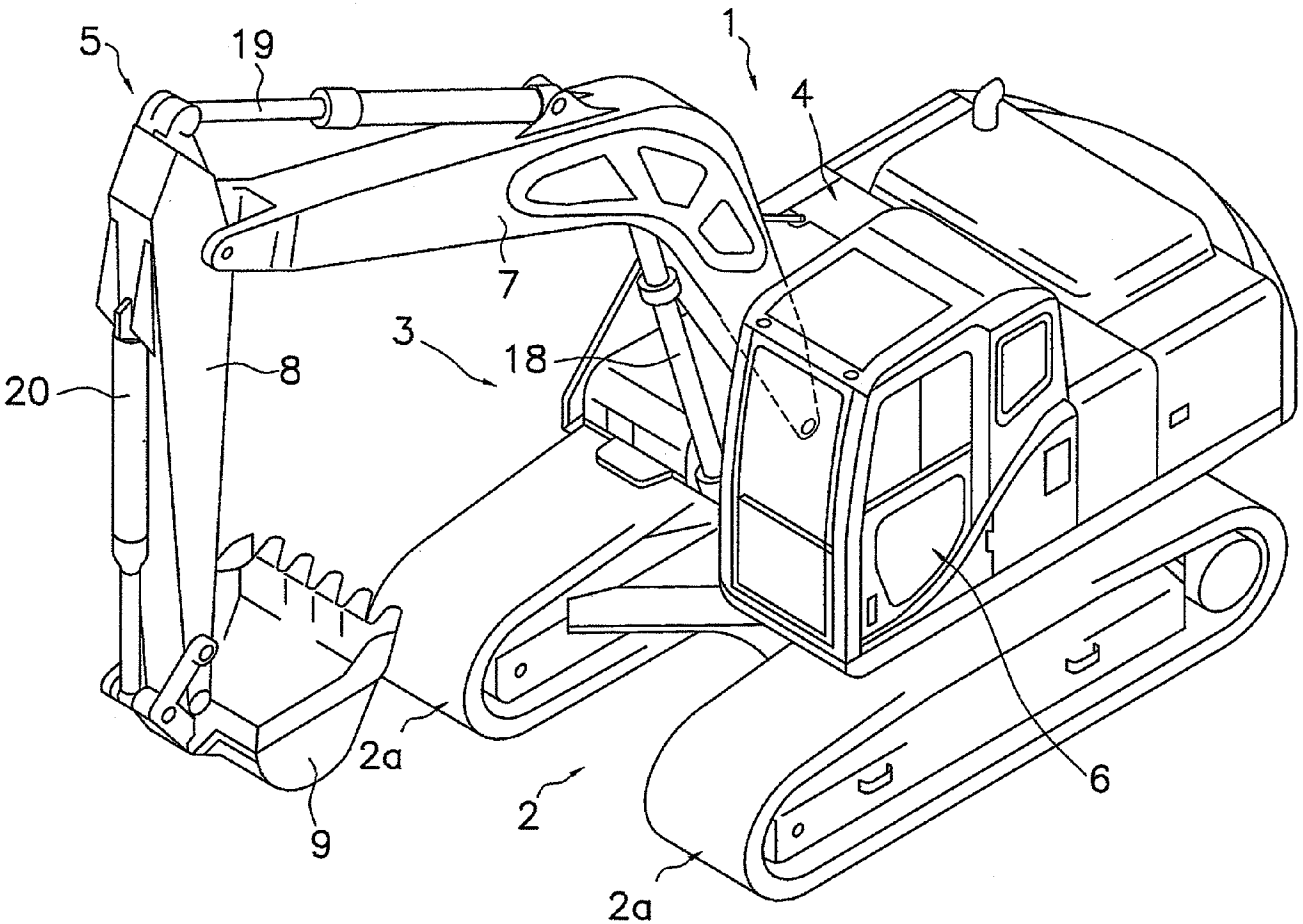
FIG. 1 is an external perspective view of a construction machine provided with a work equipment boom according to the present invention.

A construction machine 1 provided with a work equipment boom 7 according to an embodiment of the present invention is shown in FIG. 1. The construction machine 1 is a hydraulic shovel, and the construction machine 1 is provided with a work equipment 5 including the work equipment boom 7, and a main body 3 to which the work equipment boom 7 is attached.

The main body 3 is configured comprising a lower traveling body 2 having travel apparatuses 2*a* driven by a travel hydraulic motor, a revolving apparatus (not shown) driven by a revolving hydraulic motor, an upper revolving body 4 placed on top of the lower traveling body 2 via the revolving apparatus, and an operator cabin 6 provided in a front left position of the upper revolving body 4.

The work equipment 5 is attached to a front center position of the upper revolving body 4. In the work equipment 5, the work equipment boom 7, an arm 8, and a bucket 9 are turnably linked in the stated order beginning from the upper revolving body 4, and hydraulic cylinders (a boom cylinder 18, an arm cylinder 19, and a bucket cylinder 20) are arranged so as to correspond respectively to the work equipment boom 7, the arm 8, and the bucket 9. The construction machine 1 is provided with hydraulic circuitry (not shown), and oil discharged from a hydraulic pump driven by an engine is supplied and discharged to the boom cylinder 18, the arm cylinder 19, and the bucket cylinder 20, thereby driving the hydraulic cylinders 18 to 20.

The work equipment boom 7 has a curved external shape, and one end of the work equipment boom 7 is attached to the main body 3. Specifically, one end of the work equipment boom 7 is rotatably attached to the upper revolving body 4. The other end of the work equipment boom 7 is rotatably attached to the arm 8, and the work equipment boom 7 can be rotated about a rotational axis parallel to the horizontal direction by being driven by the boom cylinder 18. The work equipment boom 7 is thereby capable of swinging vertically in relation to the upper revolving body 4. One end of the arm cylinder 19 is rotatably fixed to the top surface of the work equipment boom 7. One end of the boom cylinder 18 is rotatably fixed to the bottom surface of the work equipment boom 7. The other end of the boom cylinder 18 is rotatably fixed to the upper revolving body 4. The work equipment boom 7 will be described in detail hereinafter.

The arm 8 is a member having a tapering external shape, and is rotatably provided to the distal end of the work equipment boom 7. The arm 8 can be rotated about a rotational axis parallel to the horizontal direction by being driven by the arm cylinder 19. The arm 8 is thereby capable of swinging relative to the work equipment boom 7. One end of the bucket cylinder 20 is fixed to the top surface of the arm 8. The other end of the arm cylinder 19 is fixed to the rear end of the arm 8.

The bucket 9 is rotatably provided to the distal end of the arm 8, and the bucket can be rotated about a rotational axis parallel to the horizontal direction by being driven by the bucket cylinder 20. The bucket 9 is thereby capable of swinging relative to the arm 8. The other end of the bucket cylinder 20 is fixed to the rear end of the bucket 9.

Configuration of Work Equipment Boom 7

Figure 2:
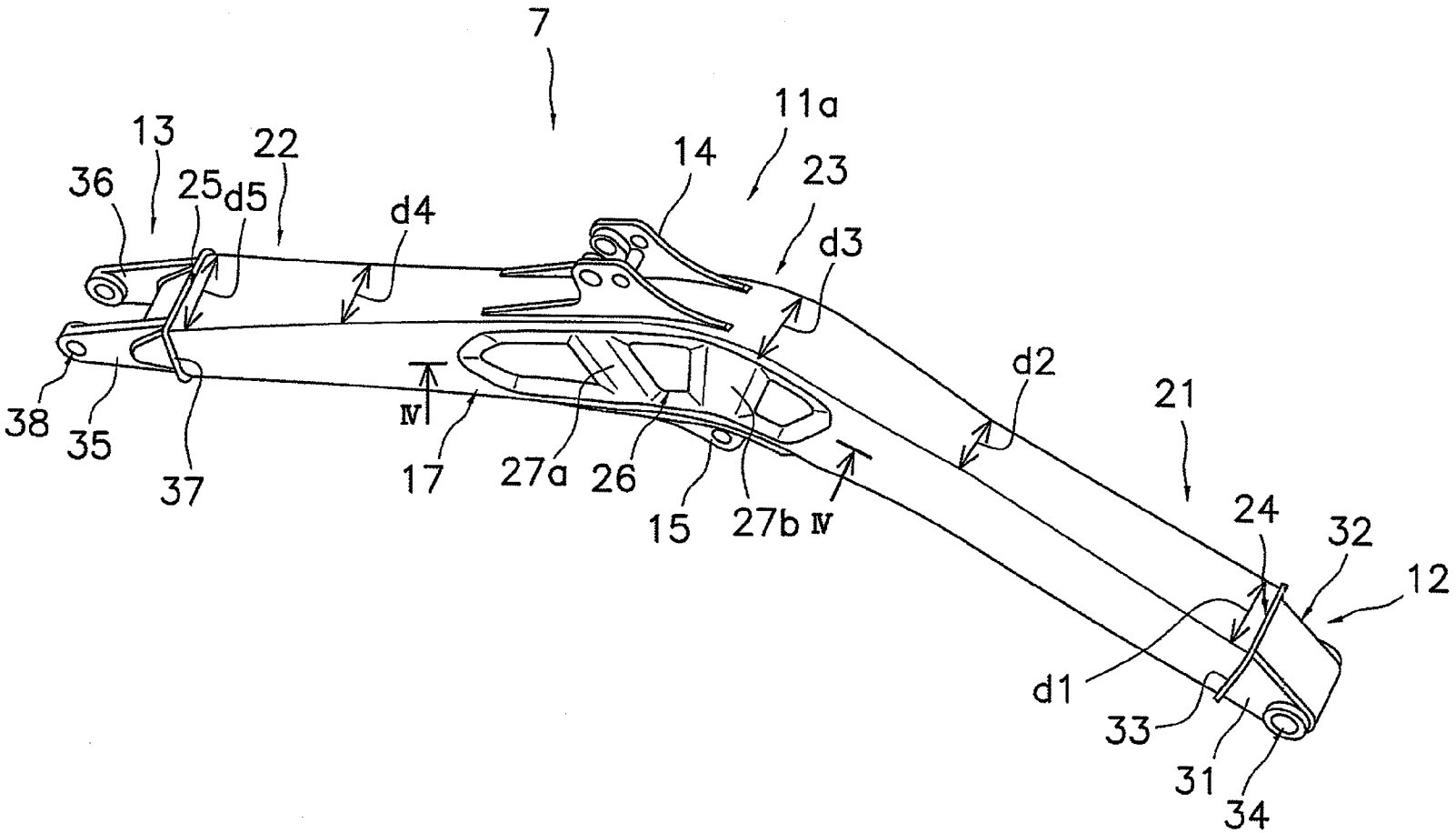
FIG. 2 is an external perspective view of the work equipment boom.

The work equipment boom 7 is provided with a boom main component 11*a*, a first bracket 12, a second bracket 13, a third bracket 14, and a fourth bracket 15, as shown in FIG. 2.

Boom Main Component 11*a*

Figure 4:
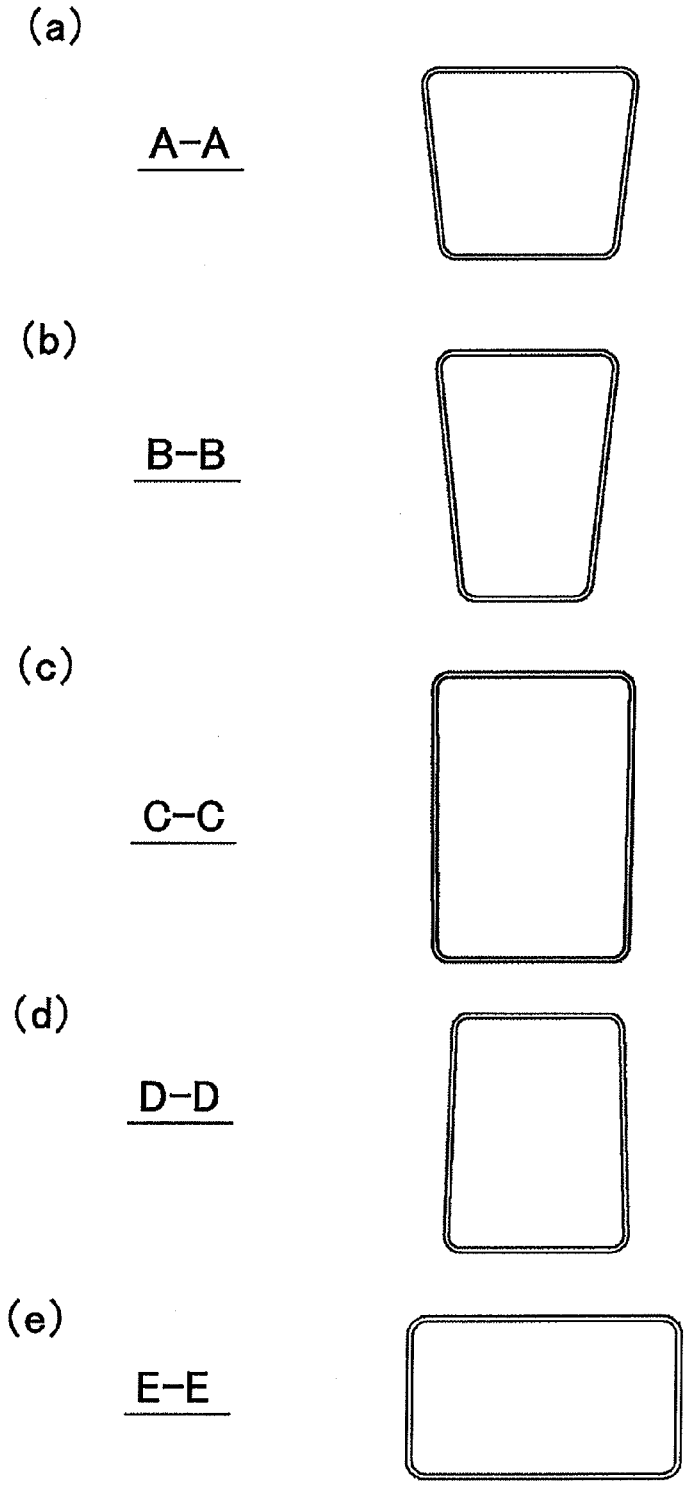
FIG. 4 is a cross-sectional view of the boom main component.

The boom main component 11*a* has a shape which is curved in the longitudinal center part, and has a substantially rectangular cross-sectional shape rounded at the corners (see FIG. 4). The boom main component 11*a* is integrally formed by expanding a tubular material by hydraulic formation, as is described hereinafter. Therefore, the boom main component 11*a* has a structure with no seams. The boom main component 11*a* has a proximal end portion 21, a distal end portion 22, and a center portion 23. Along the longitudinal direction of the work equipment boom 7, the side attached to the main body 3 is referred to the "proximal end side," and the side attached to the arm 8 is referred to as the "distal end side."

Figure 3:
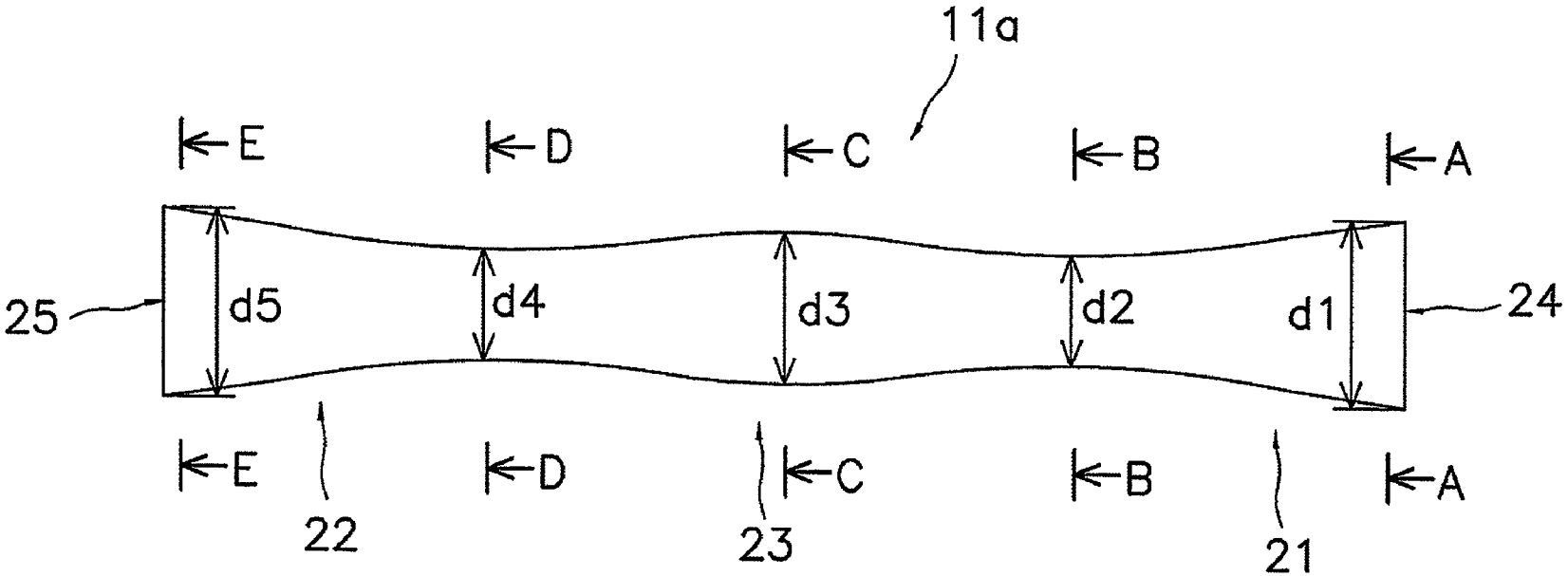
FIG. 3 is a top view of a boom main component.

The proximal end portion 21 includes a first end part 24 to which the first bracket 12 is attached, and has a shape which increases in horizontal width nearer to the first end part 24, as shown in FIG. 3. FIG. 3 is a top view of the boom main component 11*a*. The cross section of the first end part 24 is a trapezoid as shown in FIG. 4(*a*), and the cross section of a part in the distal end side of the proximal end portion 21 is a vertically long trapezoid as shown in FIG. 4(*b*). The proximal end portion 21 has a shape which decreases in vertical width (height) nearer to the first end part 24, as shown in FIG. 2.

The distal end portion 22 includes a second end part 25 to which the second bracket 13 is attached, and has a shape which increases in horizontal width nearer to the second end part 25, as shown in FIG. 3. The cross section of the second end part 25 is a horizontally long rectangle as shown in FIG. 4(*e*), and the cross section of a part in the proximal end side of the distal end portion 22 has a vertically long trapezoid as shown in FIG. 4(*d*). The distal end portion 22 has a shape which decreases in vertical width nearer to the second end part 25, as shown in FIG. 2.

The center portion 23 is positioned between the proximal end portion 21 and the distal end portion 22 and is joined continuously with the proximal end portion 21 and the distal end portion 22 without seams. The third bracket 14 for fixing the bucket cylinder 20 is fixed to the top surface of the center portion 23, as shown in FIG. 2. The fourth bracket 15 for fixing the boom cylinder 18 is fixed to the bottom surface of the center portion 23. The center portion 23 has a shape which decreases in horizontal width nearer to the distal and proximal ends, and the horizontal width in the longitudinal center part is greater than the horizontal widths of the distal and proximal ends. The cross section of the center part in the longitudinal direction of the center portion 23 is a vertically long rectangle, as shown in FIG. 4(*c*). In the center portion 23, the vertical width in the longitudinally center part is greater than the width in the distal and proximal ends, as shown in FIG. 2. Therefore, the boom main component 11*a* has a shape which decreases in vertical width nearer to the first end part 24 and the second end part 25.

As described above, the boom main component 11*a* has a shape in which the horizontal width and vertical width change continuously along the longitudinal direction. Specifically, the boom main component 11*a* has a shape in which the horizontal width changes continuously so that the horizontal width d1 of the first end part 24 to which the first bracket 12 is attached, the horizontal width d5 of the second end part 25 to which the second bracket 13 is attached, and the horizontal width d3 of the center part between the first end part 24 and second end part 25 are greater than the horizontal widths d2, d4 of the other portions, as shown in FIG. 3. The horizontal width d1 in the first end part 24, the horizontal width d3 in the center part, and the horizontal width d2 of the portion between the first end part 24 and center part have the relationship d1>d3>d2. The horizontal width d5 in the second end part 25, the horizontal width d3 in the center part, and the horizontal width d4 of the portion between the second end part 25 and center part have the relationship d5>d3>d4.

Figure 5:
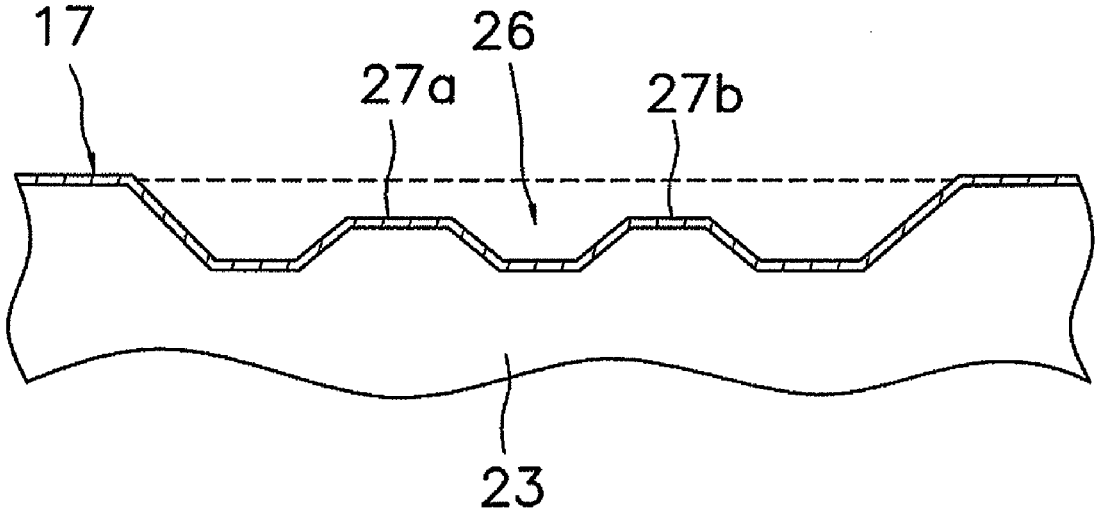
FIG. 5 is a cross-sectional view along line IV-IV in FIG. 2.

A concave part 26 that is concave inward from the side surface 17 of the curved portion is formed in a side surface 17 of the curved portion of the boom main component 11*a*, as shown in FIG. 2. The concave part 26 has a shape which extends along the longitudinal direction of the boom main component 11*a* and curves in accordance with the shape of the boom main component 11*a*. Convex parts 27*a*, 27*b* are formed in the side surface 17 of the curved portion of the boom main component 11*a* so as to traverse the concave part 26. Specifically, the convex parts 27*a*, 27*b* are formed vertically through the concave part 26, and two convex parts 27*a*, 27*b* are provided separated by an interval in the longitudinal direction of the boom main component 11*a*. Therefore, the concave part 26 is divided by the two convex parts 27*a*, 27*b* into three portions aligned along the longitudinal direction of the boom main component 11*a*. The peaks of the convex parts 27*a*, 27*b* are positioned further inward than the side surface 17 of the boom main component 11*a* and farther outward than the bottom surface of the concave part 26, as shown in FIG. 5. In FIG. 2, one side surface 17 of the curved part of the boom main component 11*a* is shown, but the side surface on the opposite side has the same shape.

First Bracket 12 and Second Bracket 13

The first bracket 12 shown in FIG. 2 is attached to one longitudinal end of the boom main component 11*a*; i.e., to the first end part 24, and the first bracket is a member for attaching the work equipment boom 7 to the main body 3 of the construction machine 1. The first bracket 12 is formed by welding together sheet metal, and the first bracket 12 has a first side surface 31, a second side surface 32, and a first flange 33. The first side surface 31 and the second side surface 32 are flat plate-shaped components, and these surfaces have linear shapes along the longitudinal direction of the boom main component 11*a* as viewed from above. The first flange 33 is fixed to the ends at the distal ends of the first side surface 31 and second side surface 32. The end surface at the distal end of the first flange 33 is fixed to the first end part 24 of the boom main component 11*a*. A hole 34 running through the horizontal direction is formed through the first bracket 12, and a fixing pin (not shown) for attaching the work equipment boom 7 to the main body 3 is passed through this hole 34.

The second bracket 13 is attached to the other longitudinal end of the boom main component 11*a*; i.e., to the second end part 25, and the second bracket 13 is a member for attaching the work equipment boom 7 to the arm 8. The second bracket 13 is formed by welding together sheet metal, and the second bracket 13 has a third side surface 35, a fourth side surface 36, and a second flange 37. The third side surface 35 and the fourth side surface 36 are flat plate-shaped portions, and these surfaces have linear shapes along the longitudinal direction of the boom main component 11*a* in a top view. The second flange 37 is fixed to the ends at the proximal ends of the third side surface 35 and fourth side surface 36. The end surface at the proximal end of the second flange 37 is fixed to the second end part 25 of the boom main component 11*a*. A hole 38 running through the horizontal direction is formed through the second bracket 13, and a fixing pin (not shown) for attaching the arm 8 to the work equipment boom 7 is passed through this hole 38.

Method for Manufacturing Work Equipment Boom 7

Figure 6:
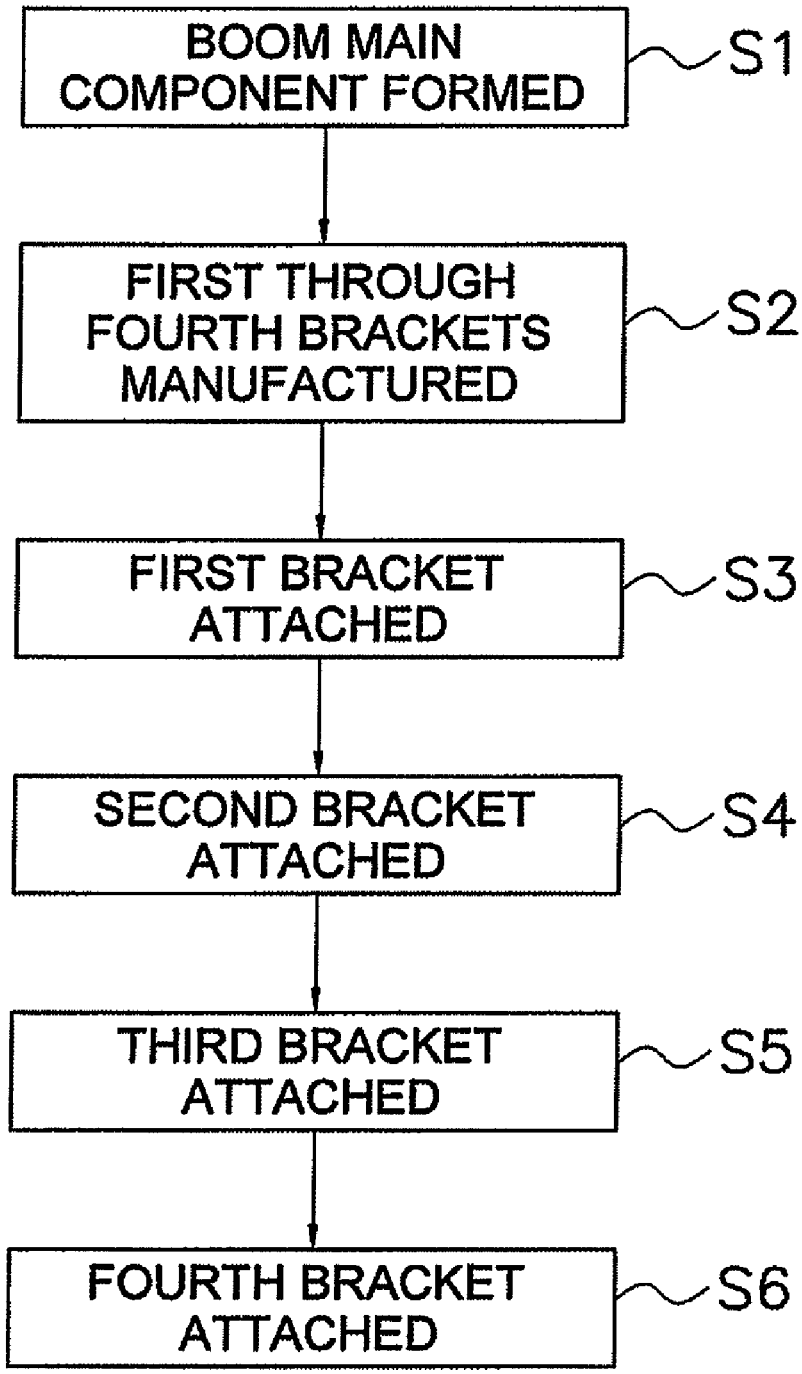
FIG. 6 is a flowchart showing the method for manufacturing the work equipment boom.
Figure 7:
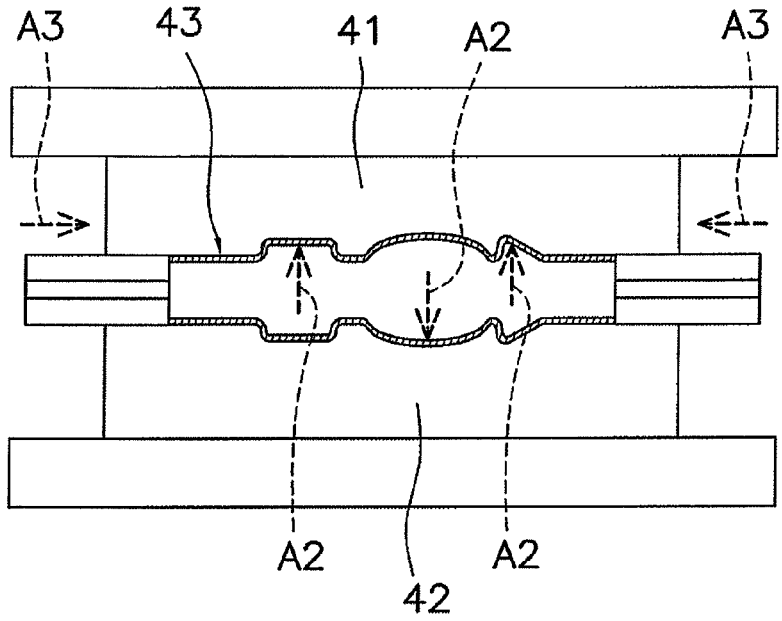
FIG. 7 is a drawing showing the fundamental principle of hydraulic formation.

Next, the method for manufacturing the work equipment boom 7 will be described based on the flowchart shown in FIG. 6.

First, in the first step S1, the boom main component 11*a* is formed. A steel pipe having no seams is hydraulically expanded (hydroformed) into the shape of the boom main component 11*a* as described above. At this time, the concave part 26 and the convex parts 27*a*, 27*b* of the side surface 17 of the boom main component 11*a* are formed simultaneously. The hydraulic formation is a plastic forming process wherein a tubular material 43 is placed between metal dies 41, 42, pressure is applied to the inside surface of the tubular material 43 by a liquid (see the dashed arrows A2), and a compressive force is applied in the axial direction (see the dashed arrows A3), thereby yielding a product shape conforming to the metal dies 42, 43.

In the second step S2, the first through fourth brackets 12 to 15 are manufactured. The brackets 12 to 15 are manufactured by welding together a plurality of metal sheets.

Figure 8:
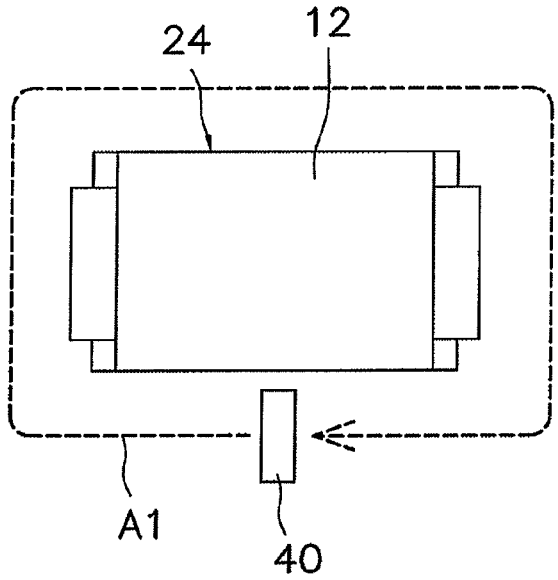
FIG. 8 is a drawing showing the movement of a welding apparatus when the first bracket is welded.

In the third step S3, the first bracket 12 is attached to the boom main component 11*a*. The first bracket 12 is fixed to the boom main component 11*a* by welding the first flange 33 of the first bracket 12 to the boom main component 11*a*. At this time, a welding apparatus 40 is moved from the starting end of welding around the periphery of the first end part 24 of the boom main component 11*a* and returned to the starting end (see the dashed arrow A1) as shown in FIG. 8, during which welding is continuously performed. The seam between the first end part 24 of the boom main component 11*a* and the first bracket 12 is thereby welded.

In the fourth step S4, the second bracket 13 is attached to the boom main component 11*a*. The second bracket 13 is herein welded to the boom main component 11*a* in the same manner as the welding of the boom main component 11*a* and the first bracket 12 in the third step S3.

In the fifth step S5, the third bracket 14 is attached to the boom main component 11*a*. The third bracket 14 is herein welded to the top surface of the boom main component 11*a*.

In the sixth step S6, the fourth bracket 15 is attached to the boom main component 11*a*. The fourth bracket 15 is herein welded to the bottom surface of the boom main component 11*a*.

Characteristics

In the work equipment boom 7, the boom main component 11*a* is integrally formed by expanding a tubular material.

Therefore, there are fewer welded portions than in cases in which the boom main component 11*a* is formed by welding a plurality of plate members as in conventional practice. Manufacturing can thereby be made easier with this work equipment boom 7, and strength can be improved.

In the work equipment boom 7, the horizontal width increases nearer to the first end part 24 and the second end part 25 of the boom main component 11*a*. Therefore, the strength of the boom main component 11*a* is improved. Since the horizontal width is enlarged, influence of the boom main component 11*a* to the turning range of the work equipment boom 7 is smaller.

The horizontal width increases nearer to the first end part 24 and the second end part 25 of the boom main component 11*a*, the horizontal width of the first bracket 12 is substantially the same as the horizontal width d1 of the first end part 24, and the horizontal width of the second bracket 13 is substantially the same as the horizontal width d5 of the second end part 25. Consequently, there is little discrepancy between the dimensions of the first bracket 12 and the first end part 24, and there is little discrepancy between the dimensions of the second bracket 13 and the second end part 25. Therefore, stress occurring in the boom main component 11*a* due to twisting or lateral stretching in relation to the first bracket 12 or second bracket 13 is reduced, and the strength of the work equipment boom 7 is improved.

Furthermore, in the work equipment boom 7, the concave part 26 is formed in the side surface 17 of the curved part of the boom main component 11*a*. Therefore, the rigidity of the side surface 17 of the boom main component 11*a* is improved, and the strength of the work equipment boom 7 is improved.

(2) The work equipment boom 7 has a comparatively complicated shape in which the horizontal width of the boom main component 11*a* changes continuously as described above. In cases in which the boom main component 11*a* is formed by welding together a plurality of plate members as in conventional practice, it is difficult to manufacture a boom main component 11*a* having such a shape. However, in the work equipment boom 7, since the boom main component 11*a* is integrally formed by expanding a tubular material, the boom main component 11*a* can be easily manufactured despite having a complicated shape such as the one described above. The concave part 26 provided to the side surface 17 of the boom main component 11*a* can also be easily formed when the boom main component 11*a* is formed from a tubular material. Furthermore, the number of components is reduced due to the boom main component 11*a* being integrally formed.

In the work equipment boom 7, rigidity is increased by increasing the horizontal width d1 of the first end part 24. Therefore, sufficient strength can be ensured even if the first end part 24 and the first bracket 12 are fixed together by plain butt welding without internal welding. The welding for fixing the first end part 24 and first bracket 12 together is thereby simplified. The same applies to the fixing of the second end part 25 and the second bracket 13.

As described above, with the work equipment boom 7, the number of machining steps during manufacturing can be reduced, and manufacturing can be simplified.

Furthermore, in the work equipment boom 7, the horizontal width d1 of the first end part 24 is increased and shaped to match the horizontal width of the first bracket 12. Therefore, the first side surface 31 and second side surface 32 of the first bracket 12 can be made into linear shapes, and the manufacturing of the first bracket 12 can be simplified. Specifically, in cases in which the horizontal width d1 of the first end part 24 is small, the width at the distal end of the first bracket 12 must match the first end part 24. Therefore, the widths of the first bracket 12 at the distal end and proximal end differ, the first side surface 31 and the second side surface 32 must be formed into curved shapes, and the manufacturing of the first bracket 12 becomes complicated. However, with this work equipment boom 7, the first side surface 31 and second side surface 32 of the first bracket 12 can be made into linear shapes, and the manufacturing of the first bracket 12 can be simplified.

Figure 9:
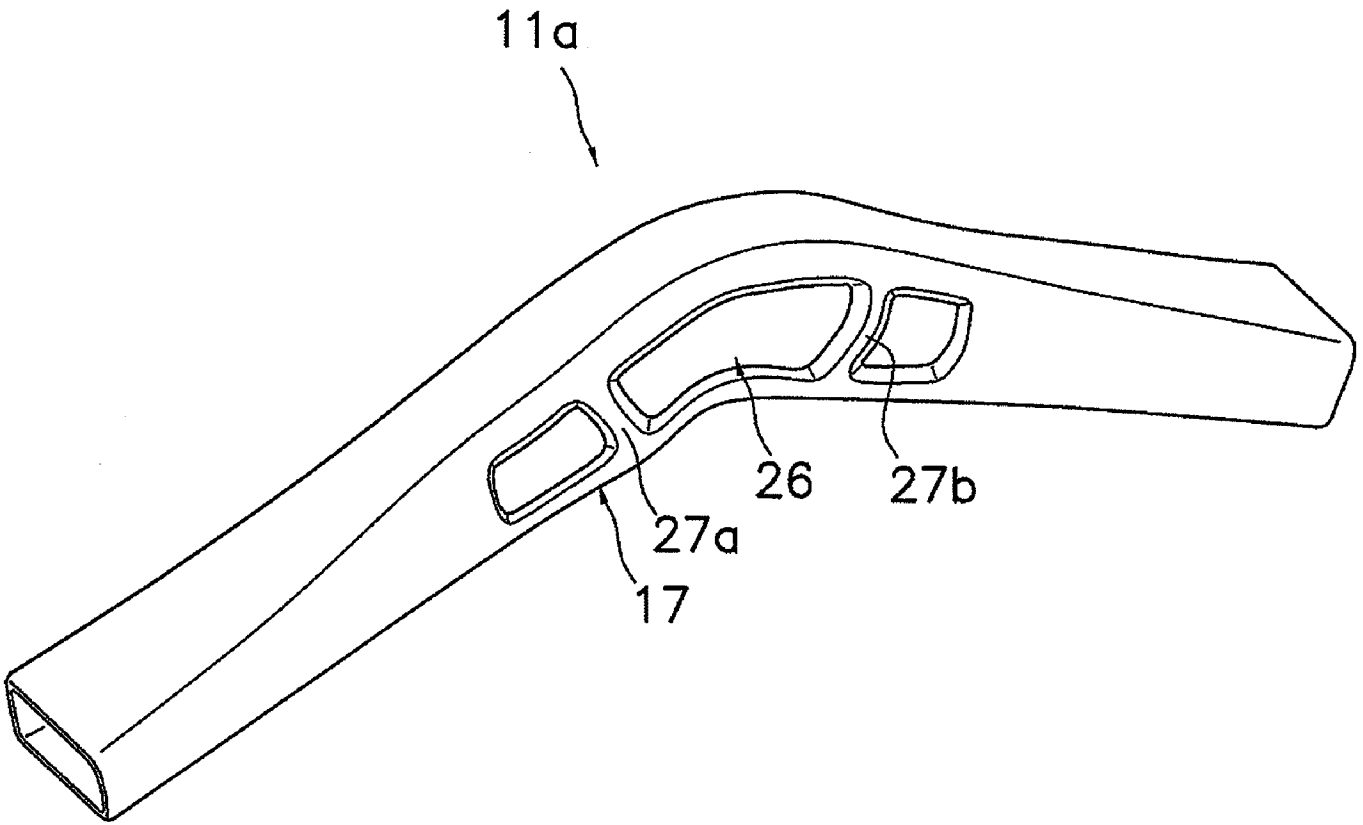
FIG. 9 is a perspective view of a boom main component according to another embodiment.

OTHER EMBODIMENTS (a) In the embodiment described above, the peaks of the convex parts 27*a*, 27*b* are positioned farther inward than the side surface 17 of the curved portion of the boom main component 11*a*, but the peaks of the convex parts 27*a*, 27*b* may also be positioned in the same plane as the side surface 17 of the curved portion of the boom main component 11*a* as shown in FIG. 9, and the convex parts 27*a*, 27*b* may be joined in the same plane as the side surface 17 of the curved portion of the boom main component 11*a*.

Figure 10:
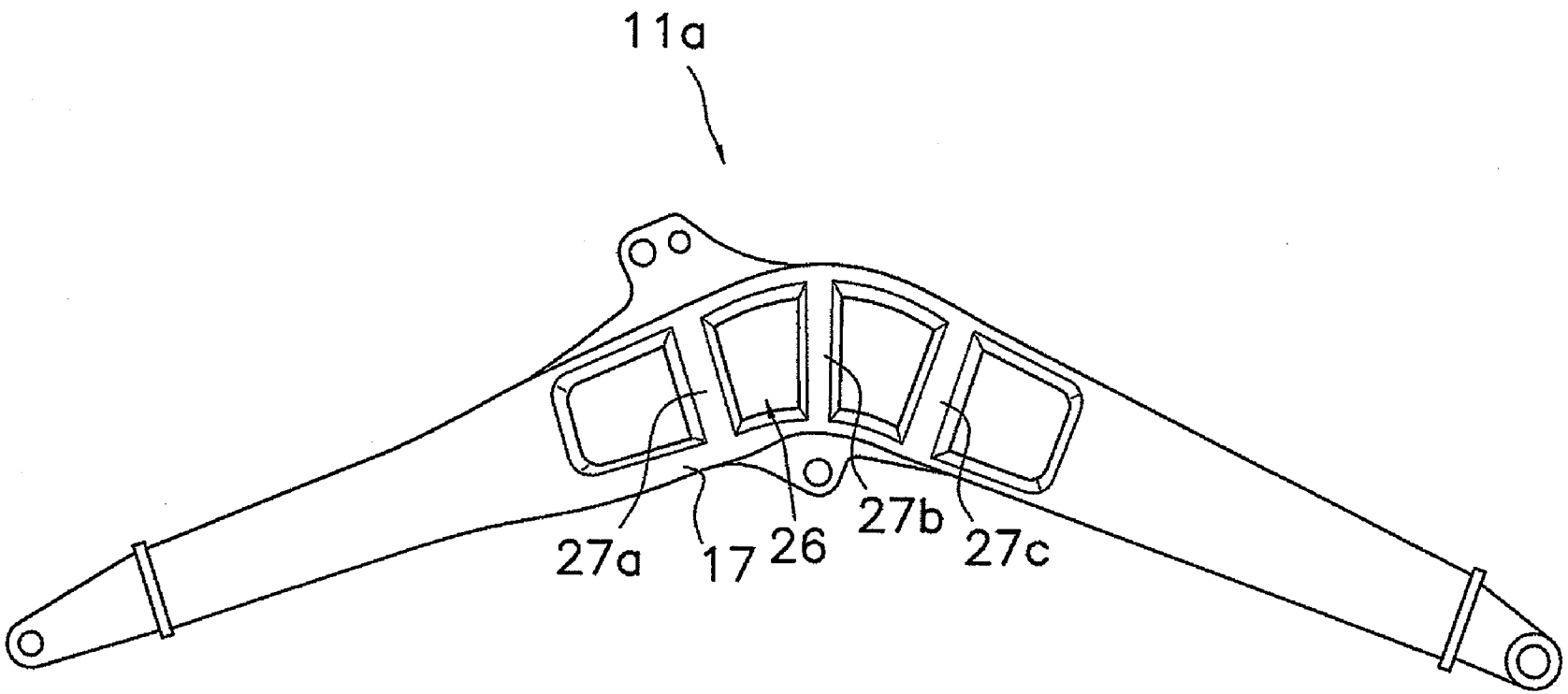
FIG. 10 is a side view of a work equipment boom according to another embodiment.

(b) In the embodiment described above, two convex parts 27*a*, 27*b* are provided, but the number of convex parts 27*a*, 27*b* is not limited to this option alone. For example, three convex parts 27*a*, 27*b*, 27*c* may be provided as shown in FIG. 10.

Figure 11:
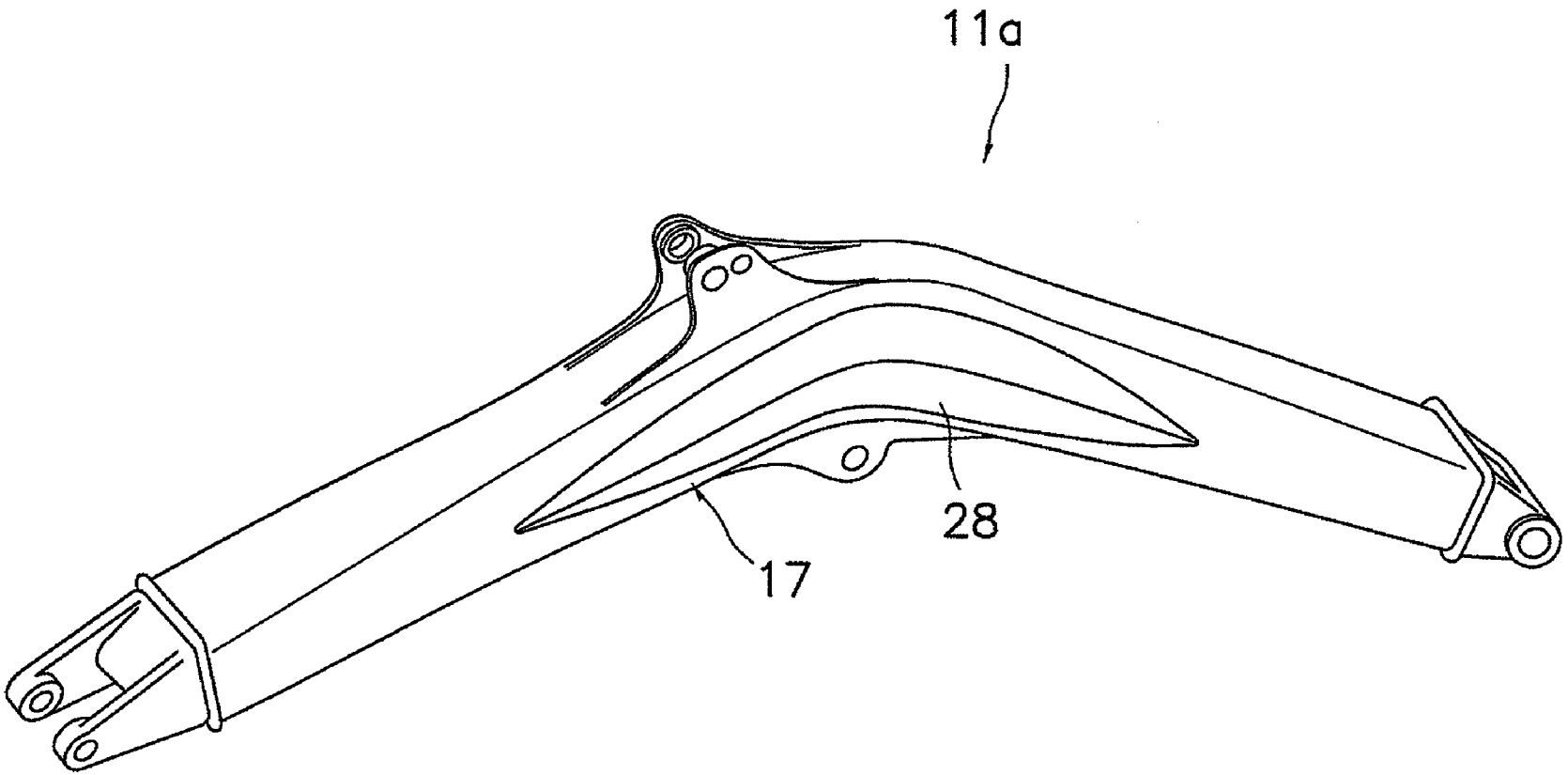
FIG. 11 is a perspective view of a work equipment boom according to another embodiment.
Figure 12:
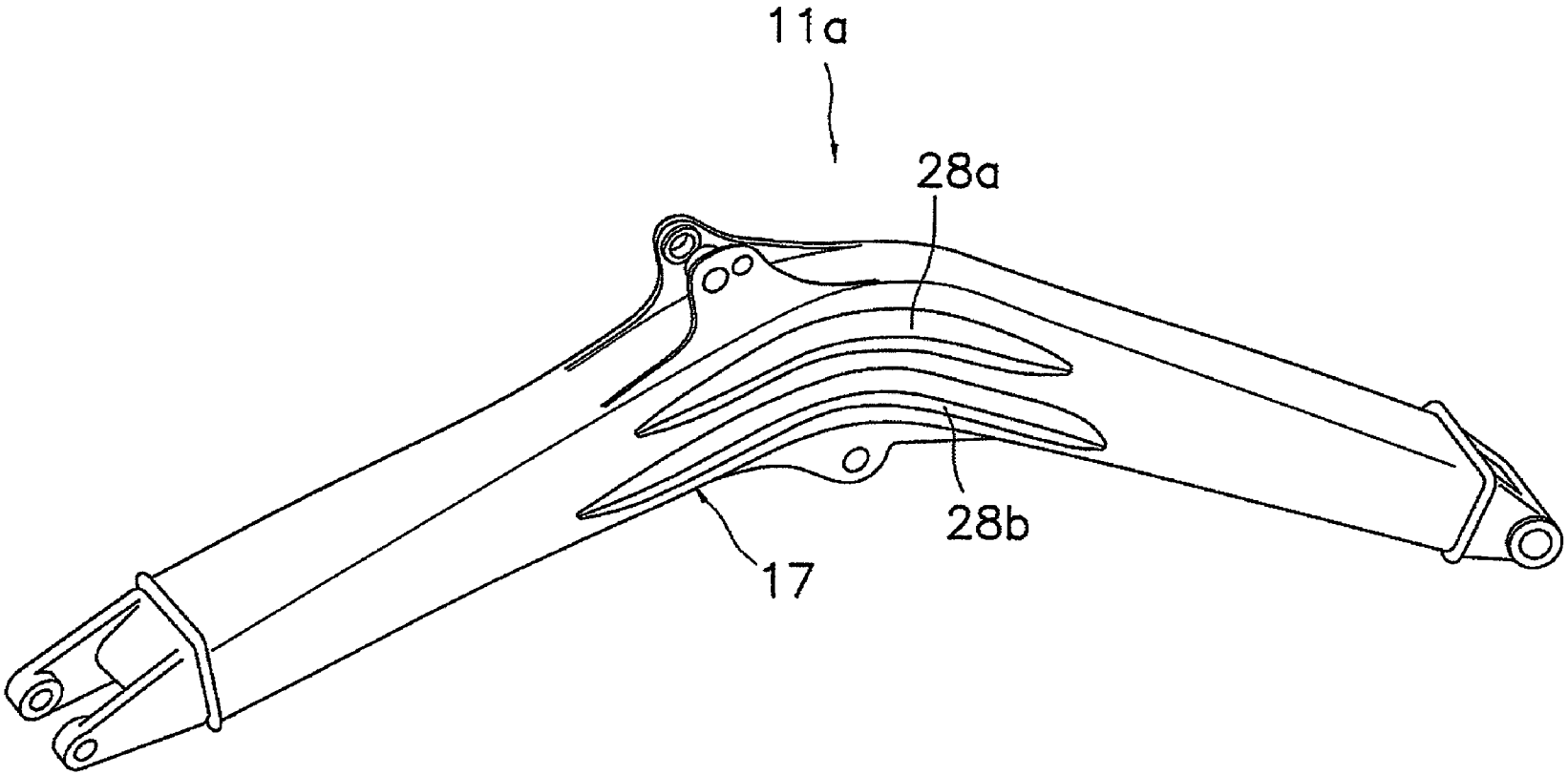
FIG. 12 is a perspective view of a work equipment boom according to another embodiment.

(c) In the embodiment described above, a concave part 26 is provided so as to be concave inward in the side surface 17 of the curved portion of the boom main component 11*a*, but a convex part 28 may be provided as shown in FIG. 11. In this case as well, the rigidity of the side surface 17 of the boom main component 11*a* can be improved, and strength can be improved. The number of concave parts 26 is not limited to one, and a plurality of convex parts 28*a*, 28*b* may be provided as shown in FIG. 12.

Figure 13:
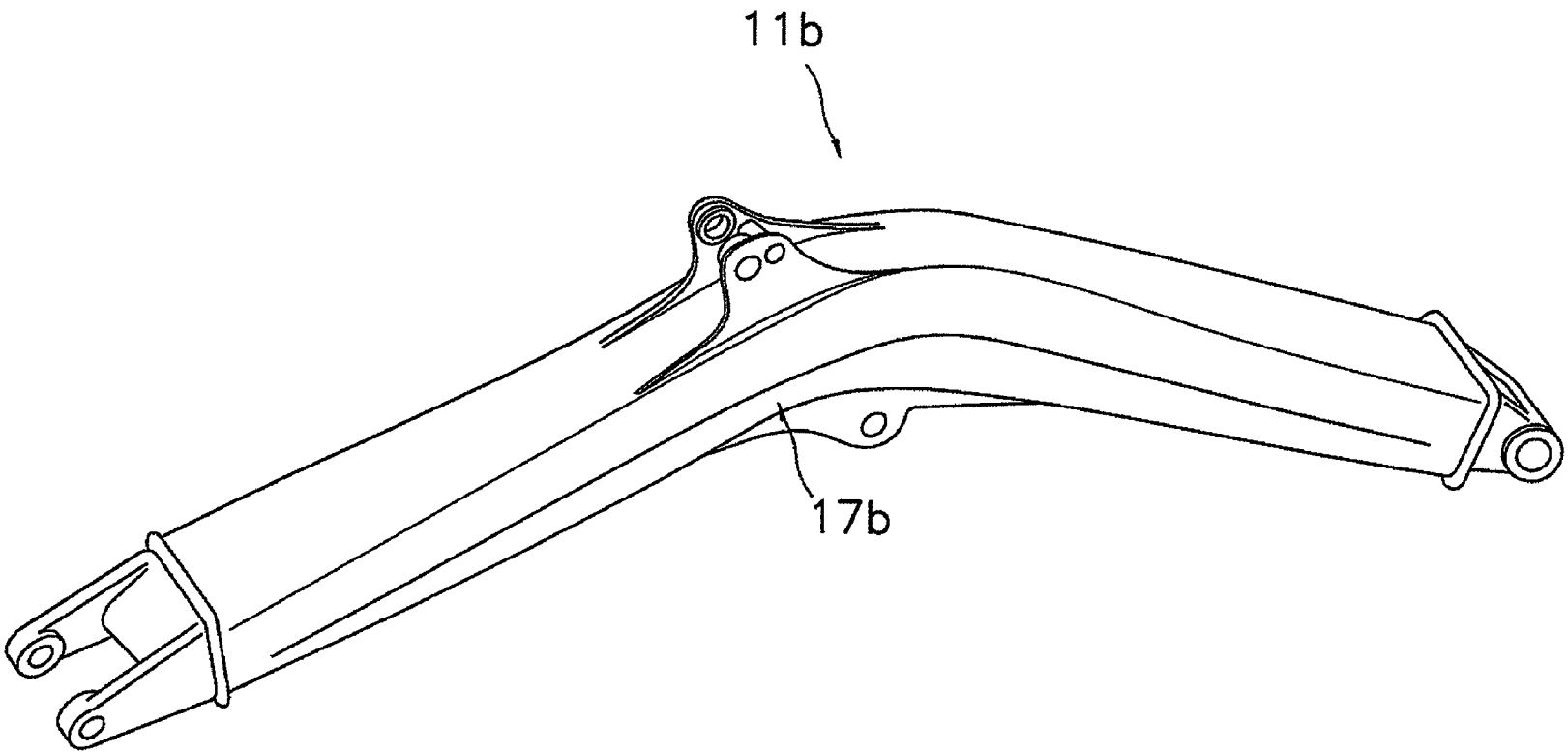
FIG. 13 is a perspective view of a work equipment boom according to another embodiment.

(d) In the embodiment described above, the boom main component 11*a* has a rectangular cross-sectional shape, and all or part of the longitudinal cross section may be a hexagon or another polygon such as in the boom main component 11*b* shown in FIG. 13. In this case as well, the rigidity of the side surface 17*b* of the boom main component 11*b* can be improved, and strength can be improved.

The strength of the boom main component 11*a* can be improved also by forming the side surface 17 of the boom main component 11*a* into a curved surface which curves either outward or inward.

(e) In the embodiment described above, the cross section in a plane perpendicular to the longitudinal direction is a trapezoid in parts of the boom main component 11*a*, but this cross section may also be a square or a rectangle. The cross section in a plane perpendicular to the longitudinal direction is a rectangle in other parts of the boom main component 11*a*, but this cross section may also be a square or a trapezoid.

(f) In the embodiment described above, the boom main component 11*a* is formed by hydraulic formation in which the tubular material 43 is expanded by a liquid, but the method for machining the boom main component 11*a* is not limited to this option alone, and can also be bulge-machined, in which part of the material is caused to bulge by applying internal pressure to the material. For example, internal pressure may be applied to the tubular material 43 by inserting rubber into the tubular material 43 and compressing the rubber.

The work equipment boom according to the described embodiments has the effect of facilitating manufacturing and increasing strength.

The invention claimed is:

1. A work equipment boom adapted to be attached to a main body of a construction machine at one end and to a work equipment arm at the other end, the work equipment boom comprising:

a boom main component integrally formed by expanding a tubular material, the boom main component having a proximal end portion including a first end part arranged to be disposed adjacent to the main body, the proximal end portion having a shape that increases in horizontal width as it gets nearer to the first end part, and a distal end portion including a second end part arranged to be disposed adjacent to the work equipment arm, the distal end portion having a shape that increases in horizontal width as it gets nearer to the second end part, the boom main component having a curved shape, with a concave part and a convex part being formed in a side surface of a curved portion of the boom main component, the convex part extending between an upper end and a lower end of the concave part so as to traverse the concave part in a generally vertical direction.

2. The work equipment boom according to claim 1, wherein the boom main component has a shape in which the horizontal widths of the first end part, the second end part, and a center part positioned between the first end part and the second end part are greater than the horizontal widths of a portion between the first end part and the center part and a portion between the second end part and the center part.

3. The work equipment boom according to claim 1, wherein a peak of the convex part is positioned further inward than the side surface of the boom main component and further outward than a bottom surface of the concave part.

* * * * *